US010692681B1

(12) United States Patent
Ives et al.

(10) Patent No.: US 10,692,681 B1
(45) Date of Patent: Jun. 23, 2020

(54) TRAVELING WAVE TUBE WITH PERIODIC PERMANENT MAGNET FOCUSED MULTIPLE ELECTRON BEAMS

(71) Applicants: R. Lawrence Ives, San Mateo, CA (US); Michael Read, Plainfield, VT (US); Patrick Ferguson, Oakland, CA (US)

(72) Inventors: R. Lawrence Ives, San Mateo, CA (US); Michael Read, Plainfield, VT (US); Patrick Ferguson, Oakland, CA (US)

(73) Assignee: Calabazas Creek Research, Inc., San Mateo, CA (US)

( * ) Notice: Subject to any disclaimer, the term of this patent is extended or adjusted under 35 U.S.C. 154(b) by 970 days.

(21) Appl. No.: 14/688,762

(22) Filed: Apr. 16, 2015

(51) Int. Cl.
*H01J 25/42* (2006.01)
*H01J 23/02* (2006.01)

(52) U.S. Cl.
CPC ..... *H01J 25/42* (2013.01); *H01J 23/02* (2013.01)

(58) Field of Classification Search
CPC .. H01J 25/42; H01J 25/34; H01J 25/44; H01J 25/46; H01J 23/02–06
See application file for complete search history.

(56) References Cited

U.S. PATENT DOCUMENTS 4,742,271 A * 5/1988 MacMaster ..... H01J 25/42 315/39.3
9,013,104 B1 * 4/2015 Ferguson ..... H01J 23/0873 219/678
2011/0121194 A1 * 5/2011 Bhatt ..... H01J 23/02 250/396 ML
2012/0133280 A1 * 5/2012 Hwu ..... H01J 23/24 315/3.5

* cited by examiner

*Primary Examiner* — Ifedayo B Iluyomade
(74) *Attorney, Agent, or Firm* — File-EE-Patents.com; Jay A. Chesavage

(57) ABSTRACT

A coupled cavity traveling wave tube has periodic permanent magnet (PPM) RF cavity structures, each of which has a plurality of permanent magnets placed substantially equidistant from a central axis, and which are outside the extent of a plurality of electron beam tunnels arranged substantially equidistant from the central axis and within the extents of the plurality of permanent magnets. Each coupled cavity RF structure is formed by adjacent ferrous polepieces and a cylindrical wall which is beyond the extent of one or more coupling apertures which couple RF energy from one coupled cavity structure to an adjacent RF cavity.

20 Claims, 6 Drawing Sheets

*Figure 1A*
Prior Art
PPM Clamshell
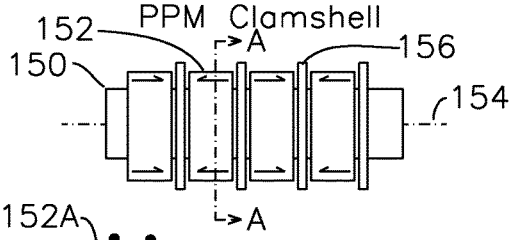
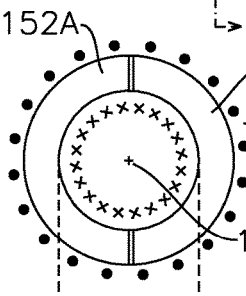
*Figure 1B*
Prior Art
Section A–A
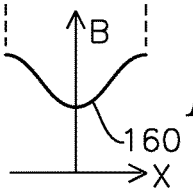
*Figure 1C*
Prior Art
*Figure 1D*
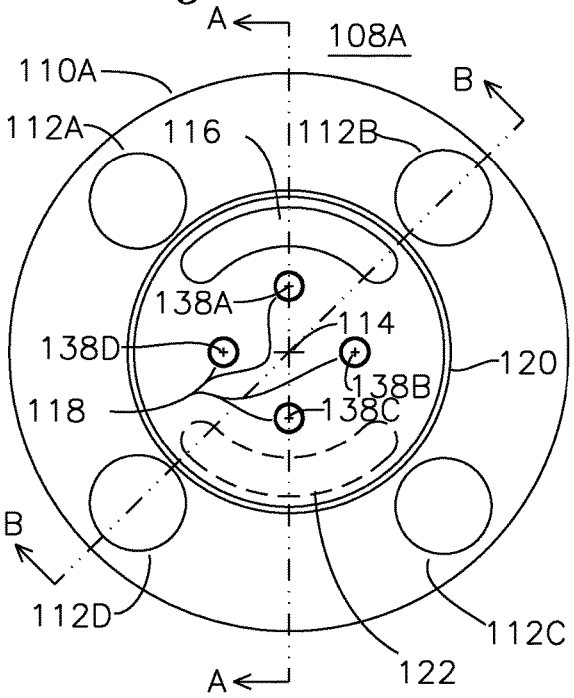
*Figure 1E*
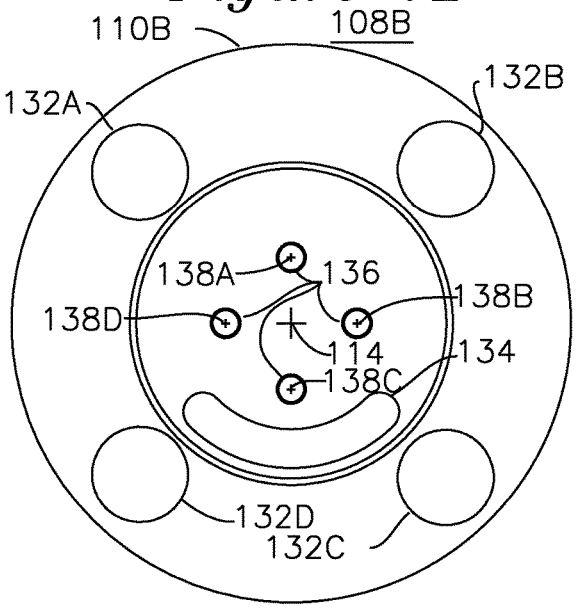
*Figure 1F*
Section A–A
*Figure 1G*
Section B–B
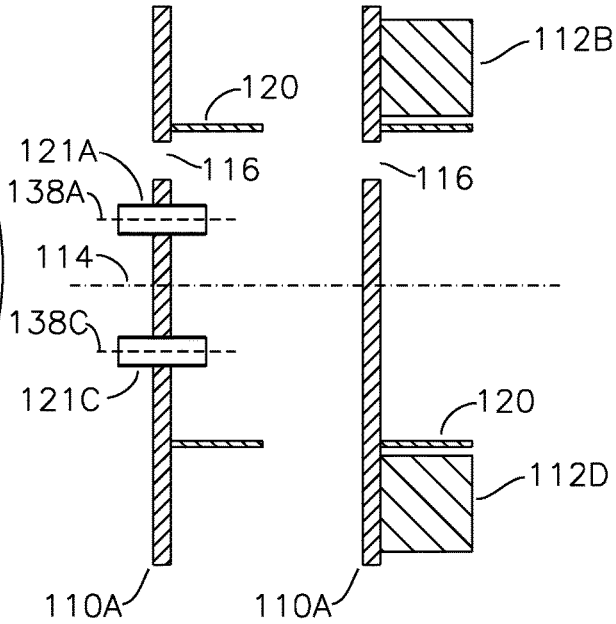

Beam Tunnels and Coupled Cavities, single RF circuit

Separate RF circuits
Section A–A

Separate RF circuits
Front View

Section C–C

Section B–B

Separate RF circuits

Separate RF circuits
Section D–D

TRAVELING WAVE TUBE WITH PERIODIC PERMANENT MAGNET FOCUSED MULTIPLE ELECTRON BEAMS

FIELD OF THE INVENTION

The present invention relates to a traveling wave tube (TWT). In particular, the invention relates to a traveling wave tube which uses periodic permanent magnets for beam focusing of a plurality of electron beams in beam tunnels coupled to the RF cavities, with the permanent magnets generating an axial magnetic field along an axial extent of a plurality of beam tunnels.

BACKGROUND OF THE INVENTION

Coupled Cavity TWTs are desirable because of their greater output power compared to helical TWT devices, and wide bandwidth compared to resonant gap devices such as klystrons. Additionally, compared to helical TWTs which can operate at a maximum frequency of 20 Ghz, coupled cavity TWTs can operate to 95 Ghz. Prior art single beam coupled cavity TWTs are limited in the maximum RF energy which may be present in the electron beam, which is governed by the beam current density, which in turn is limited by the lower operating voltage of the coupled cavity TWT.

A particular design issue of periodic permanent magnet (PPM) traveling wave tubes is illustrated in the prior art FIGS. 1A, 1B, and 1C. Prior art coupled cavity traveling wave tubes such as 150 of FIG. 1A use clamshell magnets 152 applied in pairs 152A and 152B straddling the TWT RF circuit, the magnets producing a magnetic field which is parallel to the device axis 154. FIG. 1B shows the cross section A-A of FIG. 1A, showing the axial front-facing dot and rear-facing x lines of magnetic flux from a PPM 152 clamshell assembly. The magnetic flux produced by such an assembly has a circularly symmetric but radially dependent non-uniform flux density as shown in the plot 160 of FIG. 1C showing the flux variation across the inner diameter of the clamshell magnet. The result of this non-uniformity is that the only uniform flux density location for placement of the electron beam is at the center axis 154 of the magnetic structure.

It is desired to provide a Traveling Wave Tube device for use as an amplifier or an oscillator, the traveling wave tube device having a plurality of electron beams that interact with an RF traveling wave such that energy is transferred between the electron beams and the RF traveling wave to cause axial bunching of the electron beams and increased energy in the RF wave. The input RF wave can be provided through an input RF port for an amplifier or from spurious excitation in an oscillator. The amplified RF wave is extracted through an RF output port.

OBJECTS OF THE INVENTION

A first object of the invention is a travelling wave tube device having a plurality of coupled RF cavity structures interacting with a plurality of electron beams conveyed through them, each RF cavity structure also having an aperture for coupling RF to a subsequent RF cavity, the plurality of electron beams conveyed through beam tunnels which pass through each of the RF cavity structures, the plurality of beam tunnels arranged about a central axis of the traveling wave tube.

A second object of the invention is a travelling wave tube device formed from a plurality of RF cavity structures and having a plurality of individual beam tunnels, each individual beam tunnel coupled to a series of separate RF cavities which are coupled to other RF cavities of the particular beam tunnel but isolated from the RF cavities of any other beam tunnel, each RF cavity of a particular beam tunnel coupled to an adjacent RF cavity of that particular beam tunnel on a subsequent RF cavity structure for the RF to interact with the electron beam, the plurality of beam tunnels operative in an alternating polarity magnetic field generated by a plurality of periodic magnetic field generators placed about the circumference of each RF cavity structure.

SUMMARY OF THE INVENTION

In one embodiment of the invention, a periodic permanent magnet (PPM) coupled cavity (CC) traveling wave tube (TWT) has a central axis and a plurality of RF cavity structures, each RF cavity structure comprising a ferromagnetic substrate with a plurality of magnetic field generators magnetically coupled to the ferromagnetic substrate a uniform radial distance from the central axis. Each RF structure also has a plurality of apertures forming electron beam tunnels, the plurality of electron beam tunnel apertures placed a uniform radius from the central axis. Each RF structure has RF coupling apertures for coupling RF from one RF cavity structure to the next, the apertures having a variety of different forms, including one or more circumferential slots, one or more radial slots, or non-planar coupling surfaces in the region formed between the central axis and the magnetic field generators.

The RF cavity structure for interaction with the electron beam may be arranged many ways with respect to the RF cavity coupling apertures, however the magnetic field generators alternate polarity from one RF cavity to the next RF cavity structure.

BRIEF DESCRIPTION OF THE DRAWINGS

FIG. 1A shows the side view of a prior art PPM clamshell structure applied to a TWT device.

FIG. 1B shows a cross section diagram through section A-A of FIG. 1A.

FIG. 1C is a plot of magnetic field flux density across the inner diameter of FIG. 1B.

FIG. 1D shows a front view of an RF cavity structure.

FIG. 1E shows an RF cavity structure for use adjacent to the RF cavity of FIG. 1D in one embodiment of the invention.

FIGS. 1F and 1G show cross section views of the structure of FIG. 1D.

FIG. 2B shows a plot of the magnetic field density of section A-A of FIG. 2.

FIG. 2C shows a plot of the magnetic field density of section B-B of FIG. 2.

FIG. 2D shows a plot of the magnetic field density of section C-C of FIG. 2.

DETAILED DESCRIPTION OF THE INVENTION

Figures 2, 2A:
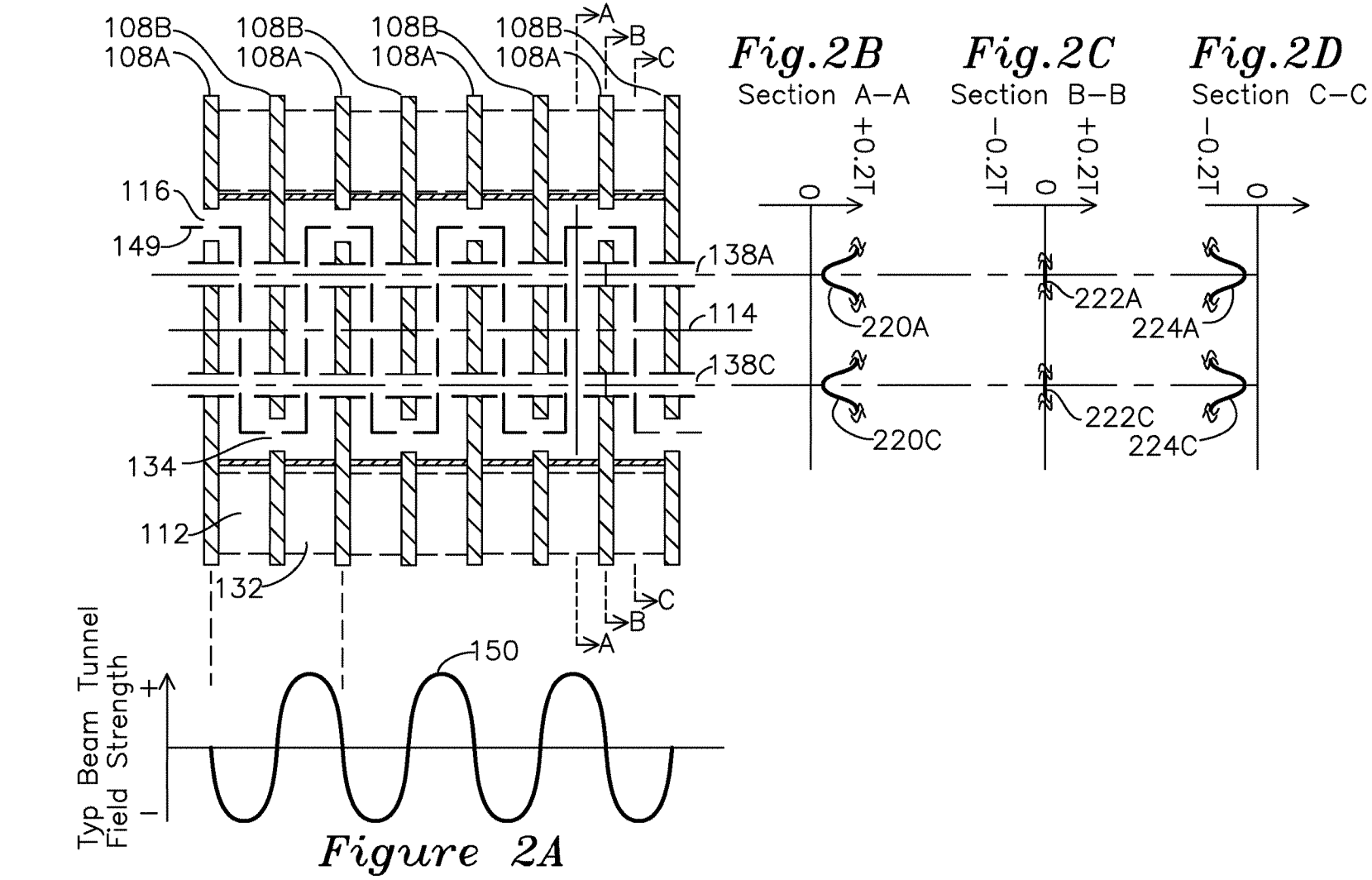
FIG. 2 shows a cross section view of a coupled cavity TWT according to one embodiment of the invention.
FIG. 2A shows a plot of the magnetic field magnitude and direction along a typical beam tunnel axis of FIG. 2.

FIG. 1D shows a transverse view of an RF cavity structure 108A, which has a magnetic circuit comprising a ferromagnetic substrate 110A and a plurality of magnetic field generators 112A, 112B, 112C, and 112D positioned substantially uniformly about the central axis 114, and with substantially equal included angles with respect to the central axis 114, thereby generating a uniform magnetic field to confine the multiple electron beams which pass through beam tunnels 118. Unlike the prior art clamshell magnetic field generators of FIG. 1A previously described, it has been discovered that the ferromagnetic substrate 110A in combination with the magnetic field generators 112A, 112B, 112C, and 112D placed beyond the extent of the electron beam tunnels 118 of the present invention generates a circularly symmetric magnetic field about each electron beam axis, which is critical for the guidance of the electron beams of the multi-beam traveling wave tube of the present invention. Any number of magnetic field generators 112A, 112B, 112C, and 112D may be used, although four are shown for clarity. Magnetic field generators 112A, 112B, 112C, 112D may be permanent magnets which are cylindrical or other suitable shape, and positioned with substantially uniform separation radius from the central axis 114, and outside the extent of the RF cavity cylindrical wall 120. Typically, the cylindrical permanent magnets 112A, 112B, 112C, and 112D are of identical construction and are positioned a uniform radial distance from the center axis 114 to create an axial 114 magnetic field which is circularly symmetric about each electron beam tunnel axis, and which reverses polarity with each subsequent RF cavity structure, as will be described. Magnetic field generators 112A, 112B, 112C, and 112D may be formed from permanent magnets using any material with magnetic anisotropy, which provides the property of aligned magnetic field generation, preferably with a high magnetic field strength, such as rare earth materials including samarium-cobalt ($SmCo_5$), neodymium iron boride ($Nd_2Fe_{14}B$), Alnico (an alloy of aluminum, Nickel, and Cobalt), or Strontium ferrite ($SrO\text{-}6Fe_2O_3$). The pole pieces 110A of FIG. 1D and 110B of FIG. 1E may be fabricated from iron or any alloy which provides coupling of the magnetic field generated by the magnetic field generators 112A, 112B, 112C, and 112D to the electron beam tunnels 118. The thickness of pole pieces 110A and 110B of FIGS. 1D and 1E, respectively, are selected to prevent magnetic saturation of the pole piece 110A and 110B by the magnetic field strength of axial magnetic field generators 112A, 112B, 112C, and 112D. In one embodiment of the invention, the ratio of the thickness of the magnetic field generator such as 112A to the thickness of the ferrous pole piece such as 110A is in the range of 3:1 to 4:1.

The RF cavity structure such as 108A has a plurality of beam tunnel apertures 118 for the passage of electron beams through the structure, one aperture 118 per electron beam. An RF cavity is formed by the ferromagnetic substrate 110A and the non-magnetic cylindrical RF cavity enclosure 120, while providing interaction between the RF and the electron beams which pass through the plurality of beam tunnel apertures 118. Each electron beam has a respective beam axis 138A and 138C, seen in the cross section view FIG. 1F. In a preferred embodiment of the invention, the electron beam tunnel apertures 118 are positioned a substantially uniform radial distance from the central axis 114, and also are uniformly spaced azimuthally about the central axis 114. The number of beam tunnels is generally independent of the number of magnetic field generators. In one example of the invention, when the number of magnetic field generators and the number of electron beam tunnels are both n, the included angle between each nearest beam tunnel is 360/n, and the included angle between each nearest magnetic field generator is also 360/n. It is preferable in this example embodiment to rotate the beam tunnels circumferentially by substantially half of the azimuthal spacing, or 180/n, as is shown in FIGS. 1D and 1E, such that the electron beam tunnels are not coincident circumferentially with the magnetic field generators. This rotation of the magnetic field generator with respect to the electron beam tunnels provides a more symmetric magnetic field to the electron beams travelling through the beam tunnels 118. The RF circuit for the RF cavity structure 108A includes the ferromagnetic substrate 110A, a cylindrical wall 120, and the coupled cavity aperture 116, which provides RF coupling to an adjacent RF cavity structure such as 108B shown in FIG. 1E, which is similar to the RF cavity structure 108A, but has the coupled cavity structure 134 rotated 180 degrees with respect to the coupled cavity aperture 116 of FIG. 1D. The RF cavities are typically formed from, or plated with, a material which optimizes the surface conductivity for efficient operation as a waveguide. The optional beam tunnel extension 121A and 121C of FIG. 1F may also have a shape or extent which optimizes the performance of the coupled cavity TWT for the desired range of frequencies or alternatively, extensions of the beam tunnel apertures 121A, 121C may not be present on any beam tunnel aperture.

FIG. 1F shows a section view A-A of FIG. 1D, including the central axis 114, local electron beam axis 138A and 138C, coupled cavity aperture 116, and cylindrical RF cavity enclosure 120. A similar cross section through section B-B of FIG. 1D (rotated 45 degrees) is shown in FIG. 1G, and includes magnetic field generator 112B and 112D, coupled cavity aperture 116, and cylindrical RF cavity enclosure 120.

The structures of FIGS. 1D and 1E are stacked successively to form a coupled cavity traveling wave tube, with the polarity of the magnetic field generators 112A, 112B, 112C, 112D all oriented in one direction for the RF cavity structure 108A of FIG. 1D, and the magnetic field generators 132A, 132B, 132C, and 132D of FIG. 1E are all oriented to generate a magnetic field with the opposite sense from those of RF cavity structure 108A.

A fundamental principle for operation of a traveling wave tube is that the speed of the RF which is traveling through the RF structures (at the speed of light) be matched to the velocity of the electrons propagating through the beam tunnel. Accordingly, the RF circuit has a path length between each interception with the electron beam which is selected such that the propagating RF field interacts with the same propagating electrons in repeated interactions through the coupled cavity traveling wave tube. The speed of the electrons through the beam tunnels may be modified (within a design range) by the applied cathode voltage at the electron gun (not shown). Accordingly, the design of a multi-beam traveling wave tube of the present invention for a particular frequency must account for the path length of the RF and velocity of the electron beams.

FIG. 2 shows a stackup of RF cavity structures 108A and 108B, with a magnetic field plot of FIG. 2A showing the associated magnetic field strength on a typical beam tunnel axis such as 138A or 138C. The placement of the magnetic field generators 112A, 112B, 112C, 112D around the outer diameter of the ferromagnetic substrate 110A and the beam tunnel apertures 118 provide a magnetic field which is circularly symmetric about each beam tunnel axis such as 138A or 138C. The axial magnetic field reverses at each RF cavity structure, as shown in the plot of FIG. 2A, for the beam tunnel axis magnetic field. The symmetry of the magnetic field around each beam tunnel can be seen in the plots 220A and 220C of FIG. 2B showing the magnetic field for beam tunnel axis 138A and 138C, respectively, through section A-A of FIG. 2. Note for FIGS. 2B, 2C, and 2D that only the magnetic field near the electron beam is relevant to the guidance of that electron beam on the electron beam axis, so the plot is truncated outside that region. FIG. 2C is truncated to show the magnetic field strength only inside the beam tunnel aperture itself, where the field is very close to 0, in the magnetic field plot 222A and 222C for section B-B through the ferromagnetic substrate 108A. FIG. 2D plots 224A and 224C show the axial magnetic field density on the opposite side of the ferromagnetic substrate, for which the magnetic field is of reversed polarity, and is similarly to FIG. 2B at a minimum at the center of beam tunnels 138A and 138C, respectively. For clarity and perspective, the magnetic field generators 112 and 132 are shown as rotated into the same circumferential position as the beam tunnels 138A and 138C. As described earlier, it is preferred that the circumferential relationship between these structures be rotated to a mid-position location, as was previously described for FIGS. 1D and 1E. The local beam tunnels such as 138A and 138C for each of the RF cavity structures 108A and 108B are oriented in the same local beam tunnel axis, and provide for the electron beam to travel through the traveling wave tube RF Cavities. In preferred embodiments of the present coupled cavity traveling wave tube, a matching number of electron beam emitters are the source for the electrons in each beam tunnel, each electron beam emitter including a thermionic cathode and anode (not shown) on the left side of axis 114 generates the plurality of electron beams along the beam axes, and a collector (not shown) is present on the right side of axis 114. The electron beam emitters may be any prior art electron beam source. The collector (not shown) on the right side of the axis 114 may be any prior art collector for spent beam dissipation. It would be undesirable to add a beam tunnel at the central axis for several reasons, including the difficulty of efficiently collecting spent electrons from the center beam, which would likely migrate undesirably backwards in the beam tunnel, as well as the difficulty of designing the RF paths such that the intersections between each RF path and each electron beam satisfies the equal propagation time constraints for each path as previously described.

The canonically reversing magnetic field for focusing the electron beams is shown in the beam tunnel field strength plot 150 of FIG. 2A, which is aligned axially with respect to the magnetic field generated by the associated magnetic field generators of each RF cavity structure 108A and 108B.

Figure 3A:
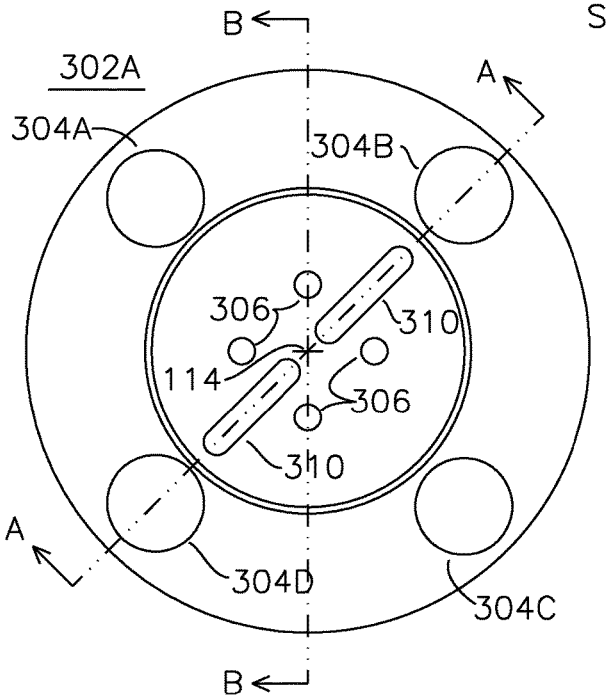
FIGS. 3A and 3B show front views of an RF cavity structure.

Many different RF cavity coupling aperture geometries are possible within the multi-beam configuration of the present invention. FIG. 3A shows an alternative RF cavity structure 302A, which has magnetic field generators 304A, 304B, 304C, and 304D, and beam tunnel apertures 306, as before, arranged about central axis 114. Coupled cavity apertures 310 are a series of radial slots 310 as shown, and the radial slot orientation may be successively rotated by 90 degrees, as shown in adjacent RF coupling structure 302B of FIG. 3B. As before, the magnetic field generators 304A, 304B, 304C, and 304D have opposite polarity from the magnetic field generators 320A, 320B, 320C, and 320D of FIG. 3B.

Figure 3C:
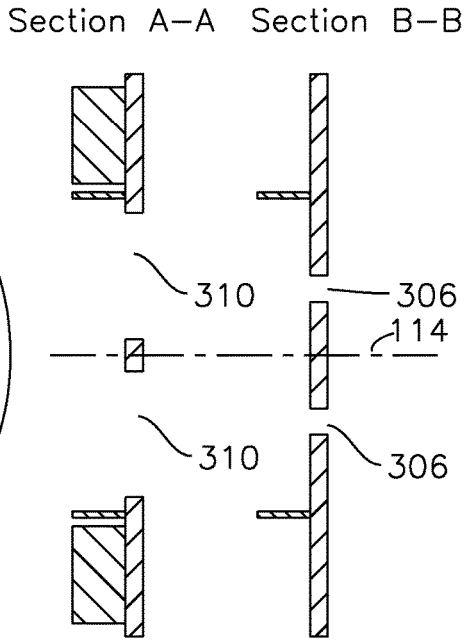
FIG. 3C shows cross section views of FIG. 3A.
Figure 3B:
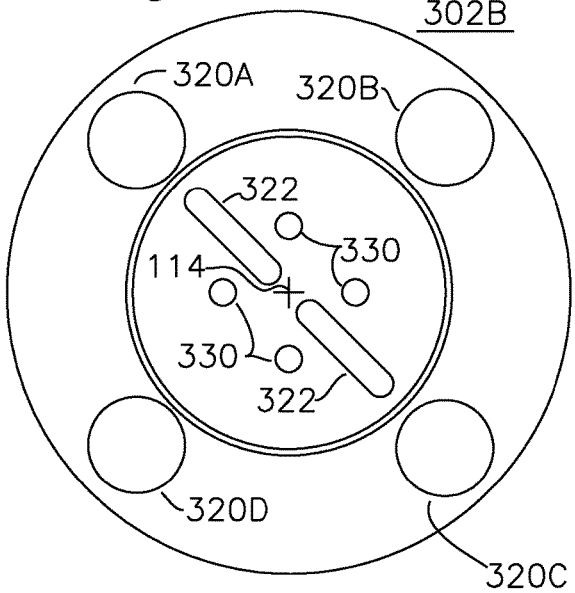

FIG. 3C shows section A-A and section B-B of FIG. 3A, including coupling cavity apertures 310 and beam tunnels 308, respectively.

Figure 4:
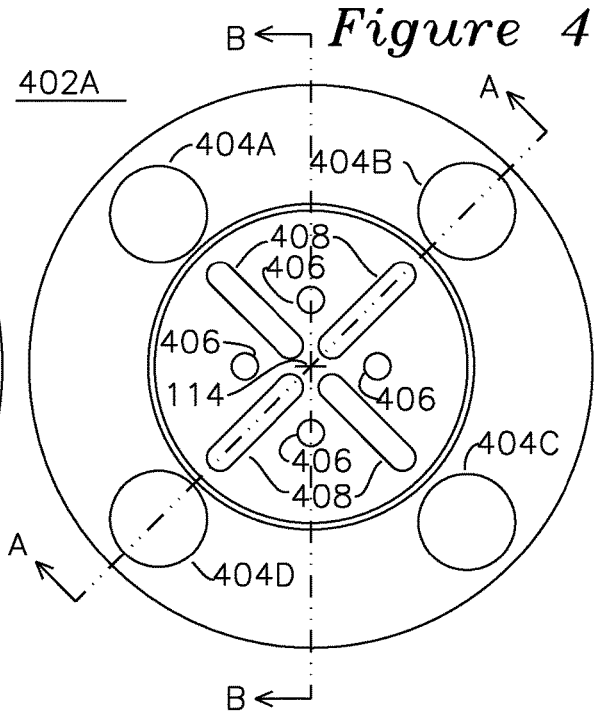
FIG. 4 show a front view of an RF cavity structure.

FIG. 4 shows another embodiment of RF cavity coupling apertures for a traveling wave tube with four radial apertures 408, such that the same RF cavity structure 402A may be successively placed along the central axis 114, with the magnetic field generators 406A, 406B, 406C, and 406D alternating polarity on successive RF cavity structures 402A, as was shown in the plot of FIG. 2A.

Many other RF coupling cavity structures may be used to form the coupled cavity traveling wave tube of the invention. The common features of the embodiments of a multi-beam coupled cavity traveling wave tube of the various FIGS. 1 through 4 are:

A traveling wave tube having:

a plurality of coupled cavity RF structures (such as 110A, 110B, or 110A/110A with coupling apertures such as 116, 134, or 122 present);

each coupled cavity RF structure having:

a plurality of magnetic field generators (such as 112A/112B/112C/112D) positioned uniformly about a central axis 114;

the magnetic field generators of a particular RF cavity structure having the same magnetic polarity with respect to the central axis;

where:

the magnetic field generators for each coupled cavity RF structure is opposite the polarity of an adjacent magnetic field generator (such as 132A/B/C/D adjacent to 112A/112B/112C/112D);

each electron beam tunnel having a common local axis shared with electron beam tunnels of adjacent structures (such as 138A/B/C/D) and a circularly symmetric magnetic field about each beam tunnel axis;

each coupled cavity RF structure having a plurality of apertures for coupling RF from one RF coupling structure to an adjacent RF coupling structure (such as 116/134 or 116/122).

Whereas the previously described FIG. 1 though 4 described a single RF path which interacts with a plurality of electron beams, FIGS. 5A through 5F shows an alternative embodiment of the invention, where each beam tunnel has its own separate RF circuit.

Figure 5B:
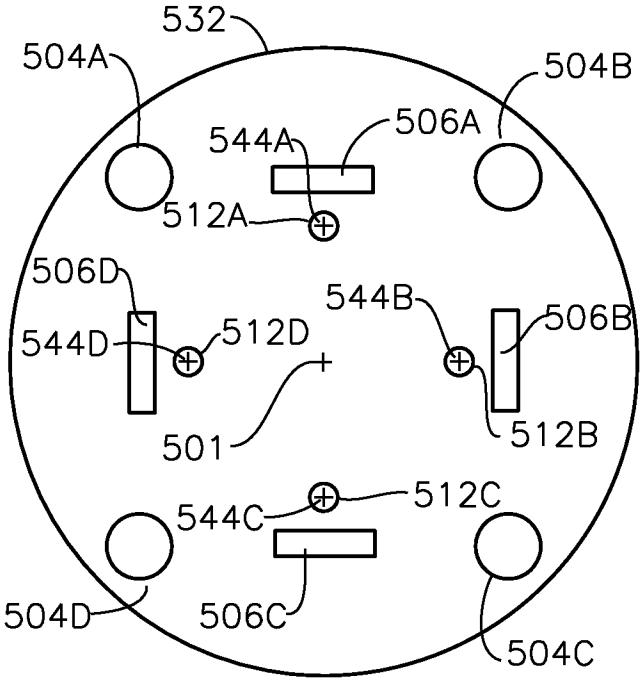
FIGS. 5B, 5C, 5D, and 5E show various section views of an RF cavity structure.
Figure 5A:
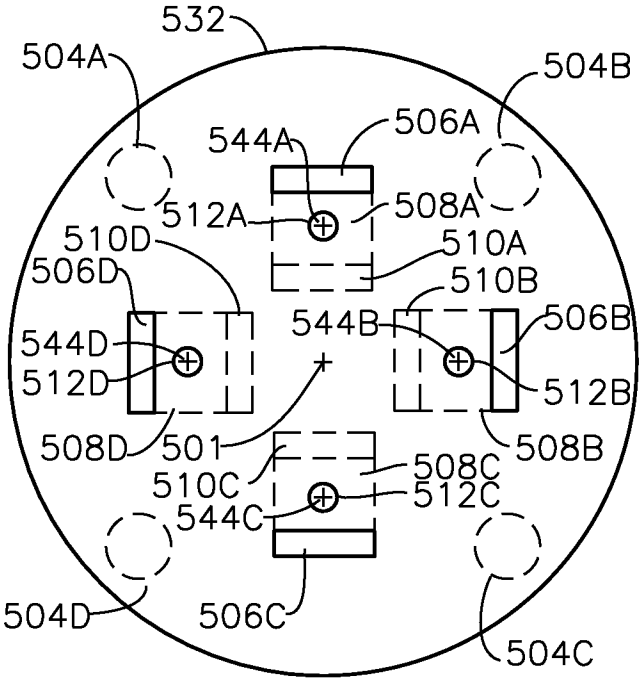
FIG. 5A shows a top view of an RF cavity structure.
Figure 5D:
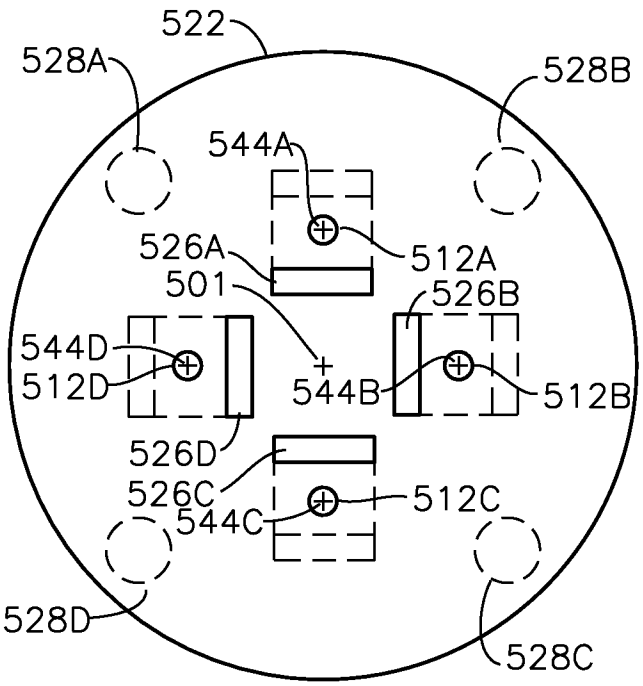
Figure 5C:
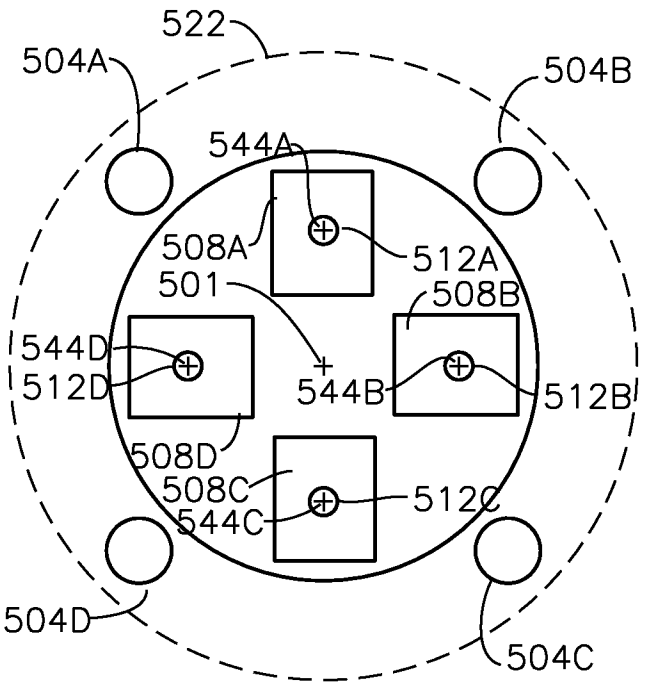
Figure 5F:
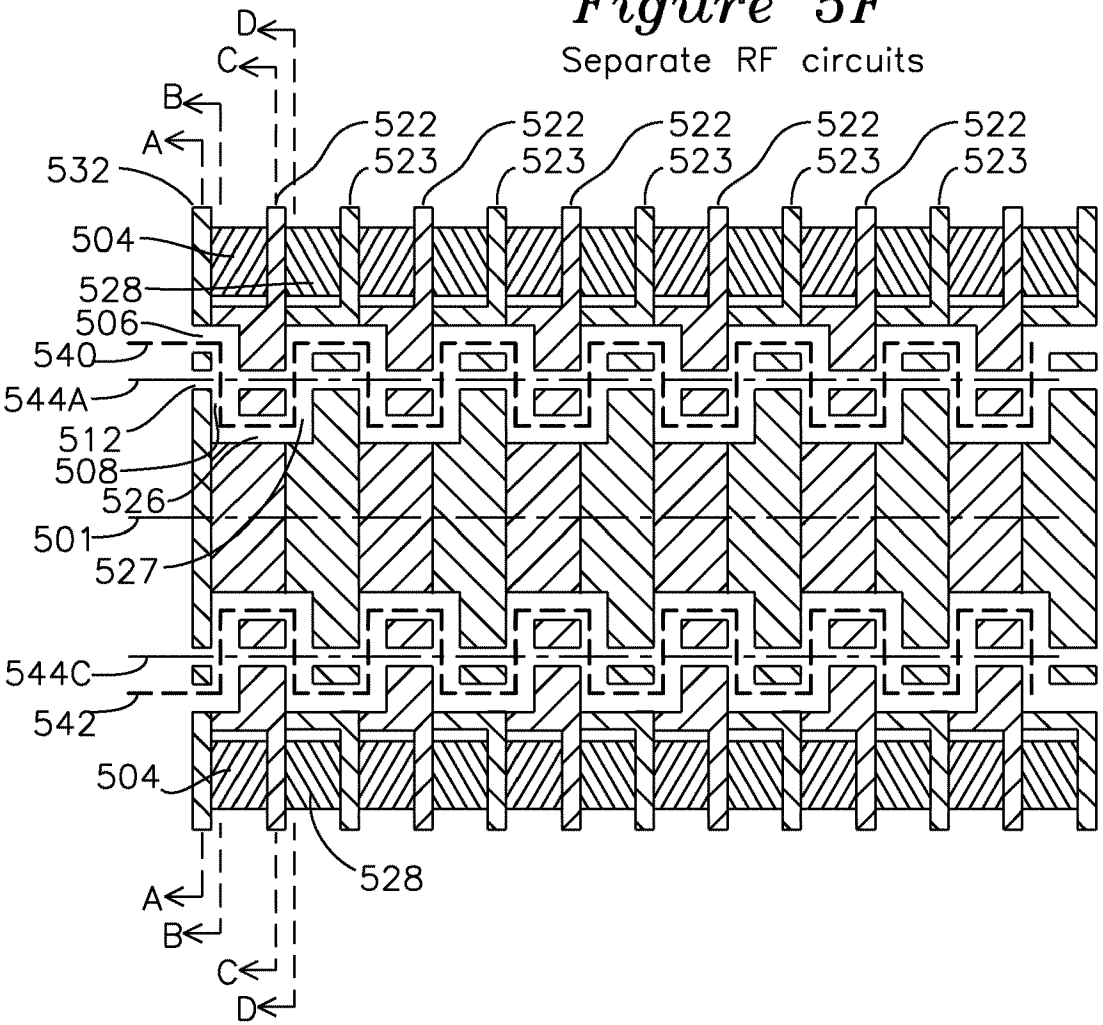
FIG. 5F shows a cross section view of a multi-beam coupled cavity traveling wave tube.

FIG. 5F shows a cross section view of a multiple-beam coupled cavity TWT with separate parallel RF paths, with section views A-A, B-B, C-C and D-D shown in FIGS. 5B, 5C, 5D, and 5E, respectively. A coupled cavity TWT constructed according to the example of FIG. 5F has an end cap 532 followed by a series of RF waveguide structures 502 and 504, each with magnetic field generators having opposite polarity compared to an adjacent magnetic field generator, as with the structure of FIG. 2. FIG. 5A shows a projected view of the end cap 532 with reference to structures behind it in dashed outline for reference. As with the earlier figures, structures indicated with dashed lines are for reference, and are not actually present in that particular view.

Figure 5E:
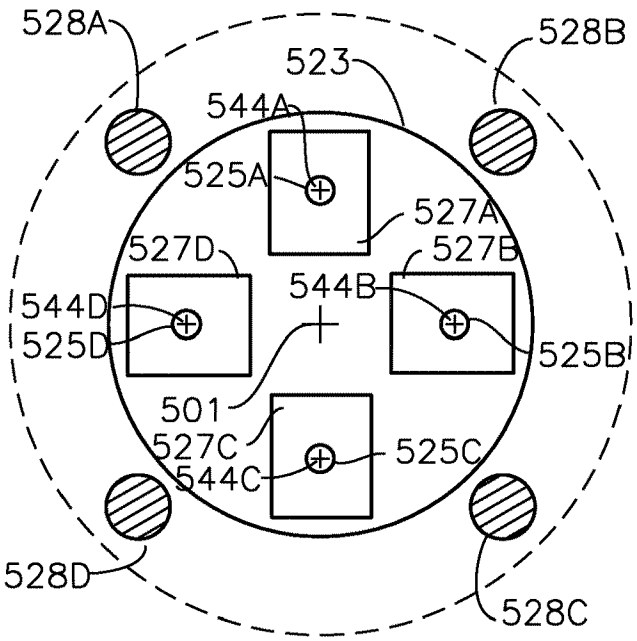

FIG. 5A shows end cap 532, with RF input apertures 506A, 506B, 506C, and 506D, as well as the (reference) magnetic field generators 504A, 504B, 504C, and 504D which are also present in the section A-A view of FIG. 5B. Also present in the projected view of FIG. 5A are the radial waveguides 508A, 508B, 508C, and 508D (visible in cross section view B-B of FIG. 5C), and the inner axial waveguides 526A, 526B, 526C, and 526D of section C-C of FIG. 5D. FIG. 5E shows the radial waveguides 527A, 527B, 527C, and 527D of section D-D of FIG. 5F.

FIG. 5F shows a cross section view which includes the various cross section views of FIG. 5B for section A-A, FIG. 5C for section B-B, FIG. 5D for section C-C, and FIG. 5E for section D-D. It can be seen that each of the waveguides of each separate beam tunnel about axis 544 provides an outer axial segment such as 506, a radial segment such as 508 which crosses the beam tunnel, followed by an inner axial segment 526, and subsequent radial waveguide 527 which again crosses the beam tunnel, with each electron beam interacting with each separate radial waveguide, and the coupled cavity TWT having operating parameters such that the transit time for the waveguide crossing the electron beam tunnel is substantially the same as the transit time for electrons in the beam tunnels to propagate from one radial waveguide to the next radial waveguide.

Regardless of which embodiment of the RF cavity structure is used, in a preferred embodiment of the invention, the RF cavity structures 522 and 523, which have pre-determined axial locations through the axial extent determined by the initial TWT design, can have the same thickness as other RF cavities, such that a large number of common elements can be used in fabricating the RF cavity structures and beam tunnel structures for economy of scale in construction.

Accordingly, the embodiments described herein are provided as example constructions, and may be practiced in any combination. For example, the cylindrical magnetic field generators may be replaced with arc section magnetic field generators for any of the described embodiments. The scope and breadth of the invention is described in the claims which follow. It should be understood in the reading of the present specification that the term substantially as applied to a particular rotational angle is +/−20 degrees, substantially parallel means parallel within +/−5 degrees, and substantially equal in length or linear measure is less than +/−10%.

We claim:

1. A coupled cavity traveling wave tube having:

a plurality of beam transport structures on a central axis, each beam transport structure having:

a plurality of magnetic field generators positioned a substantially uniform radial distance from said central axis, said magnetic field generators positioned a substantially uniform distance from adjacent magnetic field generators;

said plurality of magnetic field generators generating a magnetic field oriented in a common direction of said central axis;

a plurality of beam tunnels positioned a substantially uniform radial distance from said central axis;

an RF cavity formed by said ferrous polepiece and a substantially cylindrical wall;

each said RF cavity coupled to an adjacent RF cavity by one or more apertures in the ferrous polepiece, each aperture being at least one of a radial slot, a circumferential slot, or a rectangular aperture;

where RF is caused to propagate parallel to the central axis through the one or more apertures in the ferrous pole piece and is thereafter directed to travel perpendicular to the beam tunnels before exiting parallel to the central axis through the one or more apertures in an adjacent ferrous polepiece;

each said beam transport magnetic field generator having an opposite polarity from an adjacent magnetic field generator.

2. The coupled cavity traveling wave tube of claim 1 where n is the number of said magnetic field generators, and is equal to the number of beam tunnels.

3. The coupled cavity traveling wave tube of claim 2 where said magnetic field generators are rotated about said central axis with respect to said beam tunnels by 180/n degrees.

4. The coupled cavity traveling wave tube of claim 1 where the RF cavity has at least two surfaces bounded by the ferrous polepiece, and an associated RF cavity aperture is separately coupled to a respective beam tunnel and not to other beam tunnels.

5. The coupled cavity traveling wave tube of claim 1 where the RF cavity has at least two surfaces bounded by the ferrous polepiece, and the RF cavity apertures are coupled to a common RF cavity.

6. The coupled cavity traveling wave tube of claim 1 where each beam tunnel has vertical and horizontal apertures forming RF cavities which are not coupled to other beam tunnels or associated RF cavities.

7. The coupled cavity traveling wave tube of claim 1 where said magnetic field generators are cylindrical.

8. The coupled cavity traveling wave tube of claim 1 where said magnetic field generators are permanent magnets containing at least one of: samarium-cobalt ($SmCo_5$), neodymium iron boride ($Nd_2Fe_{14}B$), Alnico, or Strontium ferrite ($SrO\text{-}6Fe_2O_3$).

9. A multi-beam coupled cavity (CC) traveling wave tube (TWT) comprising:

a plurality of RF cavity structures arranged in a sequence about a central axis, each of said RF cavity structures comprising:

a plurality of magnetic field generators, each said magnetic field generator producing a magnetic field parallel to said central axis;

a plurality of beam tunnel apertures parallel to said central axis;

a plurality of waveguide apertures, each said waveguide aperture having a segment parallel to said central axis and a segment perpendicular to said central axis and intersecting an associated beam tunnel;

each said RF cavity magnetic field generator having an opposite polarity than a magnetic field generator of an adjacent RF cavity structure and where said segments of a particular waveguide aperture of said RF cavity structure are isolated from other segments of said RF cavity structure.

10. The multi-beam CC TWT of claim 9 where said plurality of waveguide apertures comprise rectangular apertures.

11. The multi-beam CC TWT of claim 9 where the propagation velocity of an electron beam in said beam tunnels and the path length from at least one said waveguide aperture to a subsequent waveguide aperture is selected such that the transit time for an electron traveling from a first intersection of said beam tube with said waveguide to a second intersection of said beam tube with a subsequent waveguide is substantially equal to the transit time of RF in said waveguide from said first intersection to said second intersection.

12. The multi-beam CC TWT of claim 9 where said magnetic field generators are arranged circumferentially about said central axis and substantially equally separate from an adjacent magnetic field generator of a particular RF cavity structure.

13. The multi-beam CC TWT of claim 9 where said beam tunnels are arranged circumferentially about said central axis and substantially equally separated from an adjacent beam tunnel of a particular RF cavity structure.

14. The multi-beam CC TWT of claim 9 where each beam tunnel of a particular RF cavity structure shares a beam tunnel axis with other beam tunnels of other RF cavity structures of said CC TWT.

15. The multi-beam CC TWT of claim 9 where at least one said magnetic field generator is circumferentially offset from a beam tunnel of said RF cavity structure.

16. The multi-beam CC TWT of claim 9 where said magnetic field generators are cylindrical permanent magnets.

17. The multi-beam CC TWT of claim 16 where said permanent magnets are formed from a rare earth material.

18. The multi-beam CC TWT of claim 16 where said magnetic field generators are formed from at least one of: samarium-cobalt ($SmCo_5$), neodymium iron boride ($Nd_2Fe_{14}B$), an alloy of aluminum, Nickel, and Cobalt, or Strontium ferrite ($SrO\text{-}6Fe_2O_3$).

19. The coupled cavity traveling wave tube of claim 1 where each RF cavity has at least two surfaces bounded by the ferrous polepiece, and said each RF cavity is coupled to more than one beam tunnel.

20. The coupled cavity traveling wave tube of claim 1 where at least one RF cavity is coupled to more than one beam tunnel passing through the at least one RF cavity.

* * * * *